US005299834A

United States Patent [19]

Kraige

[11] Patent Number: 5,299,834

[45] Date of Patent: Apr. 5, 1994

[54] COUPON CARD SYSTEM

[76] Inventor: Spensar Kraige, 2686 Johnson Dr., Suite B, Ventura, Calif. 93003

[21] Appl. No.: 877,101

[22] Filed: May 1, 1992

[51] Int. Cl.[5] ..... B42D 15/00

[52] U.S. Cl. ..... 283/51; 283/79; 283/80; 283/81

[58] Field of Search ..... 283/51, 79, 80, 81

[56] References Cited

U.S. PATENT DOCUMENTS

| | | | |
|---|---|---|---|
| 3,854,229 | 12/1974 | Morgan | 283/81 X |
| 4,272,327 | 6/1981 | Logan | 283/81 X |
| 4,526,405 | 7/1985 | Hattemer | 283/81 |
| 4,747,619 | 5/1988 | Sager | 283/81 X |
| 4,932,684 | 6/1990 | Vermeulen | 283/81 |

OTHER PUBLICATIONS

Miller's Office Products Catalog 1989-pp. 336, 337.

*Primary Examiner*—Paul A. Bell
*Attorney, Agent, or Firm*—Marvin E. Jacobs

[57] ABSTRACT

An array of coupons is releasably adhered to an underlying support card for easy transport, storage, and redemption. Each coupon and underlying adhesive layer is peeled off as needed. The merchant presses it onto an imprinted space on a store-maintained tracking form. The card has a central support layer of card stock, a bottom layer of reinforcing transparent plastic, and a coupon array layer formed from peel-off label stock.

10 Claims, 1 Drawing Sheet

COUPON CARD SYSTEM

DESCRIPTION

1. Technical Field

This invention concerns the coupon arts, specifically the production and efficient distribution of coupons to consumers and the collection and handling of coupons by merchants.

2. Background of the Invention

Coupons are a familiar marketing device, routinely used to promote the sale of various products and services by offering discounts or other types of effective price reduction upon presentation of the coupon to the seller. Prior art techniques include printing coupons in newspapers and flyers where they can be torn out or cut out with a scissors, assembled in bound books of coupons, and delivered in loose from by mail or by individual people who travel door to door. Whatever the form of distribution, prior art coupon systems are all somewhat disorganized, bulky, hard for the consumer to keep track of, and difficult for the merchant to handle.

The physical form of the coupon contributes to these problems. Prior art coupons are expensive to produce, inconsistent in size and shape, hard to organize and store both for the consumer and the merchant. Collections of coupons in books and the like are especially bulky, hard to carry, and present difficulty in extracting the coupon without damaging the coupon. It is possible to tear across the coupon itself when trying to tear an individual coupon form the book. Such book collections are also expensive to manufacture. All the coupons must be printed separately, perforated with tear off lines, collated, and bound into a book. These books are better organized than stacks of loose coupons or consumer collected coupons torn from the paper, but they are hard to carry around due to their size and weight, and costly to produce. The present invention avoids these problems with a new an novel physical form for collections of coupons that is compact, convenient, durable, and low in cost. Hence, a much more efficient multiple coupon system is afforded leading to more profitable fund raising activities and product promotion. The invention also provides an accurate and efficient way for the merchant to store the coupons so that the cash reconciliation with sales is easily accomplished.

SUMMARY OF THE INVENTION

Briefly, this invention contemplates an array of coupons formed on the surface of a durable and compact wallet size card, not unlike a credit card, each of which can be individually peeled off at the point of sale and presented to the redeeming agent. Since the peel off coupons are adhesive backed, once separated from the consumers card, then can be reattached easily and quickly to a sales tracking card maintained by the seller or merchant. The tracking card has a higher track surface than the coupon card so that coupons more permanently adhere to the tracking card.

Clearly, this novel form of a coupon collection is very compact and easy for the consumer to carry on his person. The peel off individual coupons are comparatively immune to physical damage because then are tough and always peel off as a whole, unlike paper coupons. Thus, they survive transfer to, and handling by the merchant. Not only are they much less bulky and easier to handle, they are also less expensive to manufacture. Once the coupons are transferred to the tracking card, they are secure from being lost and are readily counted.

These and other additional benefits, advantages and features of the invention will become apparent as the invention becomes better understood upon consideration of the following detailed description when considered in conjunction with the accompanying drawings.

DETAILED DESCRIPTION OF THE INVENTION

Figure 1:
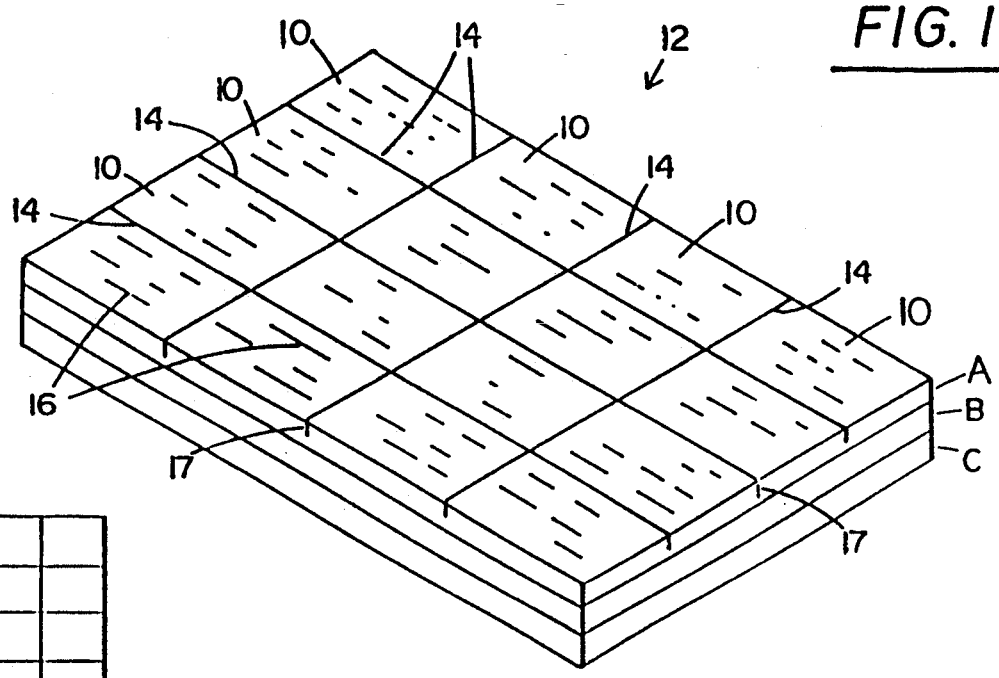
FIG. 1 is a perspective view of the card mounted array of peel off coupons of the present invention, much thickened to facilitate clarity in the drawing, showing the three mains layers that comprise the, support and coupon structure.

In FIG. 1, the collection of coupons 10 are shown detachably arrayed on the surface of a card 12. Although any number of coupons 10 may be used, sixteen are shown in the preferred embodiment since this has been found to be most convenient for a credit card sized card 12, about a little over two by three inches. Card 12 comprises three main layers: A, B, and C, each of which is commercially available at low, mass production prices. Layer B is a central thickening layer with top and bottom surfaces. Layer C is a backing layer for reinforcing the card and is mounted to the bottom surface of the central thickening layer B. Layer A contains the detachable coupons 10 and is attached to the top surface of the central thickening layer B. To separate layer A into individual discrete coupons, layer A is die cut part way through along the lines 14 in FIG. 1. Each coupon has individual writing and pictures printed thereon, symbolized in FIG. 1 by myriad randomly scattered dashed lines 16.

The coupons can all be adjacent to each other or can be separated by bands of the outer layer which are not intended to be peeled away. For example, a band may be disposed across the middle of the card and be imprinted with conditions of the promotion such as, "BUY ONE GET ONE FREE". The coupons can be any polygonal shape that interfit to form an array such as triangular, rectangular or hexagonal. Pie-shaped trangular coupons can be arranged in a circle.

Figure 2:
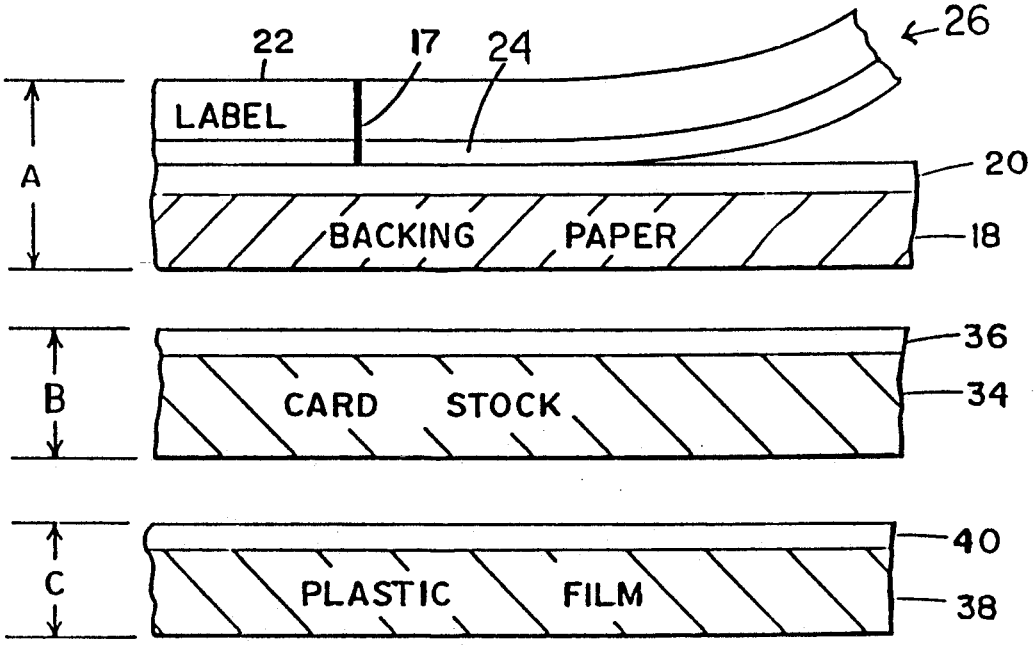
FIG. 2 is an expanded cross sectional fragmentary view of the three main layers showing the constituents of each layer, the layer of peel off coupons partially peeled away, and a typical sequence of manufacture.

In FIG. 2, layer A may be seen to comprise a relatively heavy backing paper 18 such as 60 pound white kraft paper covered by a low track layer such as a layer 20 containing a silicone release agent such as silicone resin. Removably fastened to paper 18 is a layer of peel off label stock 22 that most desirably comprises a high gloss and attractive sixty pound cast resin coated label stock secured to the backing paper 18 with an acrylic adhesive layer 24. Alternatively, label stock 22 may comprise a sheet of about 4 mil thick soft vinyl. As can be seen in FIG. 2, at 26, the label stock 22 may be peeled off, along with its layer of adhesive 24, so that discrete coupons 10 may be presented to the redeeming merchant.

Figure 3:
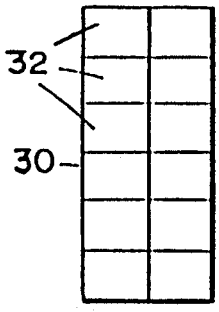
FIG. 3 shows a register tracking form upon which the peeled off coupons can be stored by the redeeming merchant.

The merchant, in turn, can easily store and accumulate the coupons 10 by pressing them onto the higher track surface 40 of a suitable register tracking form 30, as shown in FIG. 3, pressing one coupon into each imprinted receiving rectangular space 32 for a complete and organized coupon storage system. The spaces 32 are usually the same shape as the coupon 32 but may be larger to provide space to print the value of the redeemed food or other premium. The top side or bottom of the card can be imprinted with other related information such as store number, register number and total value of coupons.

In FIGS. 1 and 2, short vertical lines 17 indicate that the label stock 22 and the adhesive layer 24 are cut through by the die cut step so as to segregate the coupons into individually removable elements.

Returning to FIG. 2, layer B is shown to comprise a 8 to 24 mil layer of card stock 34, or alternatively, a layer of 8 to 10 mil plastic. Layer 34 causes card 12 to be thicker, stronger, more durable. Card stock layer 34 is fastened to layer A with a quick cure resin adhesive layer 36. Resin adhesive has low shrinkage and, thus avoids curling of card 12.

Finally, layer C comprises a one mil polyester plastic film 38 with a suitable polyester adhesive layer 40 which may be heat or pressure sensitive. The plastic layer 38 resists crease formation during the peel off of the individual coupons, making card 12 tougher so that the consumer may carry it about for an extended period of time without special attention or concern. Also, the plastic layer is transparent allowing additional generic information on the source and use of the card to be printed on the bottom of card stock 34 and viewed from the side of card 12 opposite to the coupon side.

Construction Process

As stated above, layers A, B, and C are commercially available, as is the resin type adhesive 36. The layers may be assembled in any sequence. The coupons may be cut into individual elements before or after assembly of the layer. However, in the preferred process, the label stock and card stock are printed and then the label stock is die cut into the separate coupons 10. Cutting at this stage has been found to be more precise than when done after the thicker and softer card has been assembled. Layer A is then glued to layer B with resin adhesive 36. This assembly is then adhered to layer C under pressure or heat, as appropriate. The result is a very durable array of coupons with improved longevity that is compact, light, easy to carry, and inexpensive to construct. The cost of manufacture has been found to be a small fraction of that needed for a book of coupons. Damage to the coupons is reduced and use is much easier. Coupon shapes need not be rectangular, but can be cut into other shapes as desired.

Since many minor variations are possible without departing from the spirit and scope of the invention, I intend to be limited only to the appended claims and their equivalents.

I claim:

1. A collection of coupons physically grouped or ease of use and transport on a durable, compact, credit-card sized card comprising:

a support layer comprising a central thickening layer, said support layer having top and bottom surfaces;

a reinforcing layer comprising a plastic material attached to the bottom surface of said support layer;

a top layer comprising an array of adjacent coupons;

means for adhesively attaching the top layer to the top surface of the support layer so that the coupons can be individually removed from said card and subsequently readhered to another object.

2. The coupon collection of claim 1 in which said top layer further comprises a layer of flexible label stock and a backing paper layer and wherein said means for adhesively attaching the top layer to the support layer further comprises a first adhesive layer releasably securing said flexible label stock to the top surface of said backing paper layer and a second adhesive layer adhering the bottom surface of said backing paper layer onto the top surface of said support layer.

3. The coupon collection of claim 2 in which said flexible label stock layer and said first adhesive layer are die cut into individual, adjacent elements with said elements forming said coupons.

4. The coupon collection of claim 3 further comprising a separate coupon tracking card having a high track surface adapted to receive and readhered said coupons to said high track surface for permanently receiving said coupons.

5. The coupon collection of claim 4 in which said coupons have a polygonal shape and said tracking card has prepinted spaces thereon having borders imprinted with said shape, whereby each space may receive a coupon within the borders of said space.

6. The coupon collection according to claim 1 in which the durable, compact, credit-card sized card has dimensions of approximately two inches by three inches.

7. The combination of a collection of coupons physically grouped for ease of use and transport on a durable, compact, credit-card sized card and a separate tracking card, said combination comprising:

a support layer comprising a central thickening layer, said support layer having top and bottom surfaces;

a reinforcing layer comprising a plastic material attached to the bottom surface of said support layer;

a top layer comprising an array of adjacent coupons;

means for adhesively attaching the top layer to the top surface of the support layer so that the coupons can be individually removed from said card and subsequently readhered to another object; and said another object comprising a separate coupon tracking card having a high track surface adapted to receive and readhered said coupons to said high track surface for permanently receiving said coupons.

8. The combination according o claim 7 in which each said coupon has the same polygonal shape.

9. The combination according to claim 8 in which the upper surface of said coupon tracking card has polygonal shaped borders printed thereon forming defined spaces for receiving the peeled coupons.

10. The combination according to claim 7 in which the coupons are rectangular.

* * * * *